United States Patent [19]

Burton

[11] Patent Number: 4,890,829

[45] Date of Patent: Jan. 2, 1990

[54] JUMP ROPE

[76] Inventor: Priscilla Burton, 12 University Ave., Providence, R.I. 02906

[21] Appl. No.: 246,331

[22] Filed: Sep. 19, 1988

[51] Int. Cl.[4] ..... A63B 5/20

[52] U.S. Cl. ..... 272/75; 446/236

[58] Field of Search ..... 272/74, 75, 104; 273/425; 57/233; 446/236, 431

[56] References Cited

U.S. PATENT DOCUMENTS

| | | | |
|---|---|---|---|
| 1,509,491 | 9/1924 | Sawyer | 273/425 |
| 2,161,819 | 6/1939 | Katz | 57/233 |
| 3,319,220 | 4/1968 | Kiuchi et al. | 272/104 |
| 3,325,990 | 6/1967 | Laureti | 57/233 |
| 3,415,515 | 10/1968 | Otto | 272/75 |
| 4,496,146 | 1/1985 | Jackemeyer | 272/74 |
| 4,735,035 | 4/1988 | Mattioli | 272/75 |

*Primary Examiner*—Stephen R. Crow

*Attorney, Agent, or Firm*—Barlow & Barlow, Ltd.

[57] ABSTRACT

A jump rope or similar article that can also be made into a hoop form. The article is made of materials that exhibit some stiffness and is measured as a preferred elastic modulus of approximately 26,000 p.s.i., which is roughly midway between the range of 18,000–30,000 p.s.i. The article which also exhibits a Shore A hardness of between 50 and 90 may be made from a core with spirally wound overlays treated to impart the necessary stiffness. The article has end portions that permit the joining of the ends so as to form a hoop form.

5 Claims, 1 Drawing Sheet

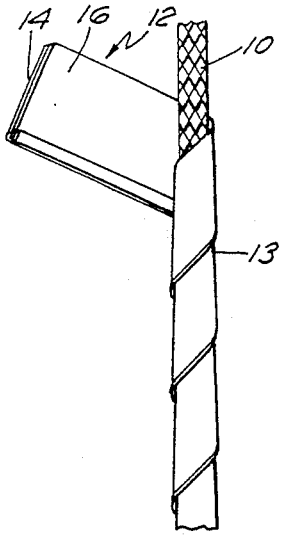
FIG. 1
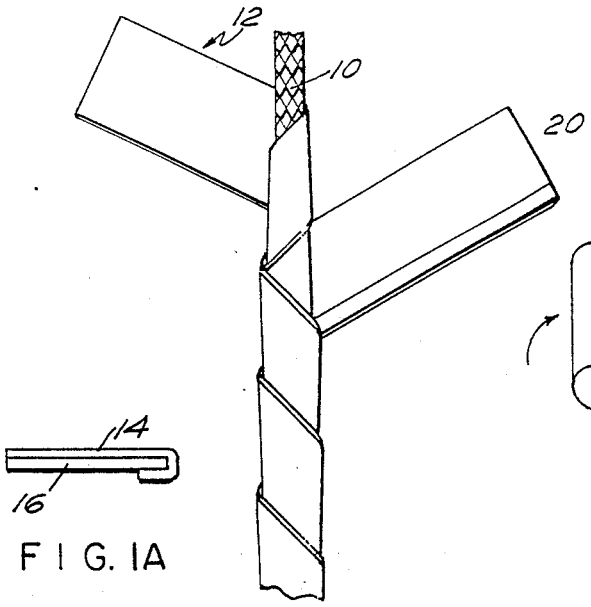
FIG. 2
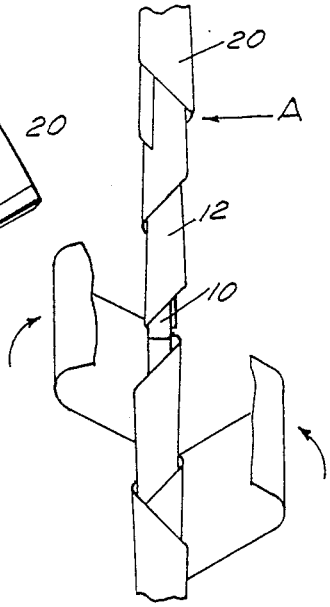
FIG. 3
FIG. 1A
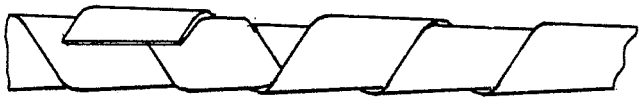
FIG. 4
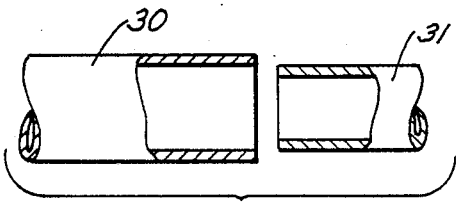
FIG. 5
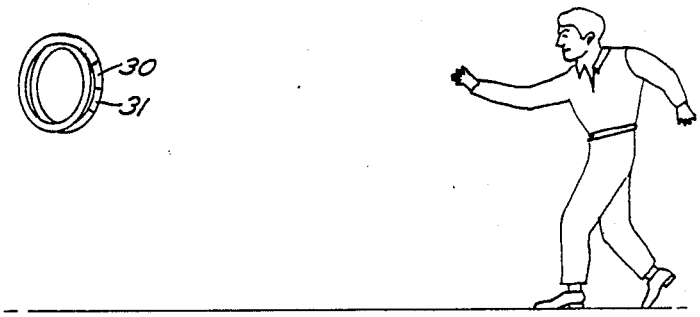
FIG. 6
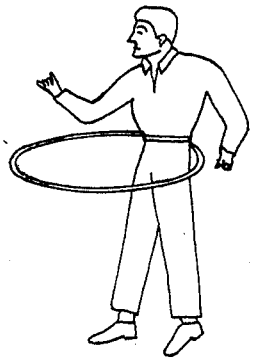
FIG. 7
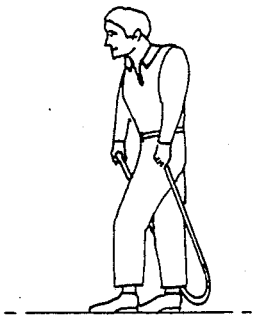
FIG. 8

JUMP ROPE

BACKGROUND OF THE INVENTION

This invention relates to a jump rope or a throwing ring or, in general, to a new article of manufacture that can be used as a game.

Jump ropes, for example, have consisted of flexible cord that is used with or without handles. In general, the flexible cord is supplied with a form of handles that are continuations of the rope and which may be held by two people and utilized for jump rope cadence or used singly by an individual. While this type of rope is suitable for jumping, it does not have common utility in developing the same as a throwing device or a hula hoop type device, due to their extreme flexibility.

The most pertinent prior art that relates to structures having some similarity to the instant disclosure, as seen, for example, in Dressel U.S. Pat. No. 2,142,308, where a plurality of parallel strands are encased in two helical covering bands.

SUMMARY OF THE INVENTION

A circular ring is formed with a single length of a core material such as a braided polypropylene fiber cord which forms a core. The core material is then covered with a first jacket of a helically wound tape so as to completely cover the core and, this first jacket is then covered with a second helically wound tape forming a second jacket which is wound about the first jacket in a direction opposite to the wind of the first jacket. The thus formed article is preferably provided with handles located at each end, one handle having a male end while the other has a female end so that the same may permit attachment to form a ring. In some cases, an outer sheath such as a soft fabric covering may be used so that the article may be easily handled. In the preferred form, the jackets made from a coated fabric which is adhered to Transiltex which is a resin impregnated polyester woven material.

DESCRIPTION OF THE DRAWINGS

FIG. 1 shows a portion of the ring in a first stage of forming over a core;

FIG. 1A is an end view of the wrapping tape;

FIG. 2 illustrates the first and second layer tape wrap over a core;

FIG. 3 shows a portion of the two ends of the strands being joined together in one form;

FIG. 4 illustrates the completed joint between the ends;

FIG. 5 is a view of two ends namely, a male and a female end that may be applied to the cord;

FIGS. 6, 7, and 8 are diagrams illustrating the manner in which the invention may be used.

DETAILED DESCRIPTION OF THE INVENTION

A braided cord 10 has wound therabout a first jacket of the helically wound tape designated 12, the tape preferably overlapping the preceeding layer by a substantial margin as seen in the drawing, wherein the edge of the tape 12 designated 13 is overlapping to approximately 50% of the previous helical wind. The tape 12 is preferably made from two layers of coated fabric, there being a first layer as seen in FIG. 1A, designated 14, which layer has a plastic coating affixed thereto while the inner layer 16 is a polyester non-woven fabric with the resin side lying adjacent the layer 14. In the preferred form, the layer 14 is made from a resin impregnated 32×36 construction woven polypropylene or jute fiber cloth. Referring to FIG. 2, it will be noted that a second jacket 20 of identical construction to the first jacket 12 is wrapped over the first jacket in a direction opposite to the wind of the first jacket. In order to keep the jackets in place after they have been wound, the layer as, for example, 16, has been coated with a white glue adhesive. Other sizings may be used as a substitute it being necessary to have a coating material that will maintain stiffness in the completed article.

The core material may ideally be a braided polypropylene strand and, by utilizing an adhesive such as a white glue on each of the jacket layers, the structure becomes less sensitive to weather influences and humidity. Other adhesives or finishing materials could be used and would include both natural and synthetic resins, varnishes or lacquers, for example.

Ideally the finished article should exhibit an elastic modulus in the midrange between 18000 and 30,000 p.s.i., as measured in accordance with ASTM Standard D790, and have a hardness between 50 and 90 on the Shore A scale. These parameters differ greatly from the conventional jump rope of the prior art where extreme flexibility is found with little or no stiffness.

The strands after they have been manufactured and covered may have suitably affixed to the ends thereof, handles or joining members such as illustrated in FIG. 5. To this end, a female part 30 and a male part 31 are illustrated, both being tubular in form and both being arranged to be secured over the first jacket layer with the second jacket layer, partly wound thereover as seen in FIG. 4. It will be apparent that, by utilizing handles such as this that the two ends of the strand may be joined together to form a circle or several strands may be joined to form a large jump rope. In some cases it may be desirable to wrap a VELCRO hook and loop fabric on the ends of the formed core to aid in keeping the ends together. Preferably the handles 30, 31 are of a resilient material such as a hose of elastomeric material.

Referring to FIG. 3 of the drawings, one form in which a circular hoop may be formed is illustrated. To this end, two abutting ends of the core 10 are brought together in line and the wrappings are left in a condition where one end, such as the upper portion as shown in the drawing, has only the first layer of tape 12 continued substantially to the end of the core 10. The other end of the article has sufficient first layer tape left so that it may be wound over the joint and onto the first layer 12 of the upper portion. Thence, the second layer tape has its wrap continued until a smooth joint is formed by completion of the wrap substantially at Point A in the drawings. The result is an article such as seen in FIG. 4 and at this stage, a covering, in the form of a soft fabric having a fluffy surface of short fibers, may be placed over the completed hoop so as to give a finished appearance thereto. Generally, this is accomplished by having the fabric as a tube in place and merely skinned back while the joint is completed.

As seen in FIG. 6, the hoop may be doubled back on itself to provide two rings and in this form, it is sufficiently small so that it can be tossed easily either by throwing outwardly as seen in the drawing to another person to be caught, or it can be tossed upwardly and caught easily by a single person. When used with a second person, it would be apparent that some may like to stretch their arm out to catch the hoop in that fashion, much the way one would play ring quoits, which provides still a further use for the rope ring. FIG. 7 illustrates a manner in which the hoop can be used which is different from a hula-hoop. The hula-hoop, being light and holow, bounces off one's body whereas the device of the instant invention, when formed into a hoop, is sufficiently stiff so that it does not bounce off one's body but acts as more or less of a semi-rigid ring. Further, the hoop can be twirled on the forearm. Finally, FIG. 8 illustrates the manner which the device can be used as a jump rope with handles on the terminal ends of the core.

The jump rope appears to reduce wrist fatiguue for in use the handles are best gripped between the thumb and forefinger and with the stiffness the rope exhibits, the rope may be easily brought from behind the user and over the head at which point it will literally "free fall" in arcuate form toward the feet. At this point the user jumps.

I claim:

1. A jump rope convertible to a closed ring for use as a game comprising a single length of a core material, a. said core material covered with a first jacket of helically wound tape so as to completely cover the core, b. said first jacket covered with a helically wound tape forming a second jacket wound about the first jacket in a direction opposite to the wind of the first jacket, c. wherein said jump rope exhibits an elastic modulus of between 18,000 and 30,000 p.s.i. (ASTM D790), d. wherein said jump rope exhibits a Shore hardness of between 50 and 90 on the A scale, e. and wherein said jump rope has handles at each end thereof, said handles having male and female terminal portions to permit the rope to be converted into a closed ring, whereby the rope may be used as a jump rope or as a hoop and the rope exhibits stiffness to maintain hoop shape and elastically to be used as a jump rope.

2. An article as in claim 1 wherein the core material is braided polypropylene.

3. An article as in claim 1 where the first jacket is a composite of two layers of a woven and a non-woven material adhesively secured together.

4. An article as in claim 1 wherein the first and second jackets are composite layers of woven polypropylene adhesively secured to a layer of non-woven polypropylene.

5. An article as in claim 1 wherein the second jacket has an outer covering thereon of a soft material having a fluffy surface of short fibers.

* * * * *